US009352760B2

(12) United States Patent
Shimokawa

(10) Patent No.: US 9,352,760 B2
(45) Date of Patent: May 31, 2016

(54) RAILWAY VEHICLE STEERING TRUCK

(71) Applicant: NIPPON STEEL & SUMITOMO METAL CORPORATION, Tokyo (JP)

(72) Inventor: Yoshiyuki Shimokawa, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 91 days.

(21) Appl. No.: 14/357,602

(22) PCT Filed: Sep. 20, 2012

(86) PCT No.: PCT/JP2012/074032
§ 371 (c)(1),
(2) Date: May 12, 2014

(87) PCT Pub. No.: WO2013/073285
PCT Pub. Date: May 23, 2013

(65) Prior Publication Data

US 2014/0310908 A1 Oct. 23, 2014

(30) Foreign Application Priority Data

Nov. 16, 2011 (JP) ..... 2011-250891

(51) Int. Cl.

| | |
|---|---|
| ***B61J 3/00*** | (2006.01) |
| ***B61F 5/50*** | (2006.01) |
| ***B61F 5/38*** | (2006.01) |
| ***B61F 3/00*** | (2006.01) |
| ***B61F 5/30*** | (2006.01) |
| ***B61F 19/00*** | (2006.01) |

(52) U.S. Cl.
CPC ... *B61F 5/50* (2013.01); *B61F 3/00* (2013.01); *B61F 5/301* (2013.01); *B61F 5/38* (2013.01); *B61F 19/00* (2013.01)

(58) Field of Classification Search
CPC ..... B61F 5/00; B61F 5/02; B61F 5/50; B61F 13/00; B61F 17/00; B61F 19/00; B61F 19/02; B61F 19/06; B60B 39/00
USPC ..... 105/96, 99, 129, 157.1, 171, 182.1, 105/185, 190.1, 453; 291/1, 2; 188/33, 83
See application file for complete search history.

(56) References Cited

FOREIGN PATENT DOCUMENTS

| | | | |
|---|---|---|---|
| JP | 27-10014 | 11/1952 | |
| JP | 53-15208 | 2/1987 | |
| JP | 63-259231 | 10/1988 | |
| JP | 6-247301 | 9/1994 | |
| JP | 3516907 | 4/2001 | |
| JP | 2005-335559 | * 12/2005 | ..... B61C 15/08 |
| JP | 2010-111329 | 5/2010 | |

* cited by examiner

*Primary Examiner* — R. J. McCarry, Jr.
(74) *Attorney, Agent, or Firm* — Clark & Brody

(57) ABSTRACT

A tread surface cleaning system has a cleaning element mounted to a truck frame of a steering truck in a position facing a tread surface of a wheel. The cleaning element moves freely to come into contact with and to move away from the tread surface. A pressing-load application spring biases the cleaning element toward the tread surface and a stopper restrains the cleaning element from approaching the tread surface. A forward and backward movement of a wheel axle 2 in the travel direction caused by steering is used so that the cleaning element makes contact only on the inner rail side toward which the tread surface of the wheel approaches when passing through a curved section. The cleaning element does not make contact on the outer rail side from which the tread surface moves away when passing through a curved section and when traveling through a straight section.

4 Claims, 2 Drawing Sheets

(a)

(b)

(c)

RAILWAY VEHICLE STEERING TRUCK

TECHNICAL FIELD

The present invention relates to a railway vehicle steering truck which steers a wheel axle of a truck, and in particular, the present invention relates to a railway vehicle steering truck which is able to clean debris such as oil adhering to a wheel tread surface, when passing through a curved section.

BACKGROUND ART

Braking systems for railway vehicles include tread brakes and disc brakes. Of these, tread brakes suitably clean a wheel tread while braking by removing debris with the brake shoe itself, even if debris such as oil adheres to the wheel tread surface, and thus they do not present a problem (e.g., Patent Reference 1, Paragraph 0007).

However, disc brakes do not clean a wheel tread while braking, as tread brakes do, so there is a problem in that once debris such as oil adheres to the wheel tread surface, it causes sliding.

Therefore, if disc brakes are installed in a railway vehicle steering truck, it is necessary to install a separate system for wheel tread surface cleaning, and to clean the wheel tread surface whenever needed.

Among wheel tread surface cleaning systems which are separately installed in railway vehicle steering trucks, there are wheel tread surface cleaning systems installed on disc brake axles which include a type which uses a constant pressure spring to continuously press a cleaning element against a wheel tread, and a movable type which presses a cleaning element against a wheel tread when necessary, in response to a signal from the railway vehicle.

Of these, the former is a simple and low-cost wheel tread surface cleaning system, but since the cleaning element is continuously being pressed against the wheel tread, there is an increased wear on the cleaning element.

In particular, when such a system is installed in a steering truck, the cleaning element is formed in such a manner that it is pressed on the wheel tread, when traveling through a straight section (see FIG. 4(*a*)), as well as when passing through a curved section (see FIGS. 4(*b*) and (*c*)). Therefore, on an inner side of a rail where a wheel approaches a truck frame when passing through a curved section (see FIG. 4(*b*)), the pressing force of the cleaning element on the wheel tread is greater than in the case of an ordinary truck, so the wear increases even more.

In FIG. 4, Reference Numeral 1 is a truck frame, 2 is a wheel axle formed from a wheel 2*a* and an axle 2*b*, 3 is a cleaning element attached so as to freely oscillate via a link 4, 5 is a constant pressure spring which presses the cleaning element 3 onto a tread surface 2*aa* of the wheel 2*a*, 6 is an axle box, and 7 is an axle spring.

On the other hand, the movable type wheel tread surface cleaning system is able to reduce wear on the cleaning element, because the cleaning element presses against the wheel tread only when necessary, but there is a problem in that it has a complex mechanism, so the system itself becomes costly.

PRIOR ART REFERENCES

Patent References

Patent Reference 1: Japanese Patent No. 3,516,907

SUMMARY OF THE INVENTION

Problems to be Solved by the Invention

One problem which the present invention aims to solve is that of increased wear on the cleaning element in the type of wheel tread surface cleaning system installed on a disc brake axle according to the prior art, in which a constant pressure spring continuously presses the cleaning element against the wheel tread. Another problem is that of a complex mechanism which results in a greater cost of the system itself in the movable type of wheel tread surface cleaning system in which the cleaning element is pressed against the wheel tread when necessary in response to a signal from the railway vehicle.

Means for Solving this Problem

The present invention has as its object to reduce wear on a cleaning element in a constant pressure type of wheel tread surface cleaning system by activating a movement of a wheel axle of a steering truck in a forward and backward direction, so as to cause the wheel tread surface cleaning system to operate only when passing through a curved section where surface lubrication has been applied.

The railway vehicle steering truck according to the present invention is a steering truck designed to make it possible to steer a wheel axle of the truck, the steering truck comprising a wheel tread surface cleaning system comprising:

a cleaning element mounted to a truck frame of the steering truck in a position facing a wheel tread surface, the cleaning element moving freely to come into contact with and to move away from a wheel tread surface, a pressing-load application spring which presses on the cleaning element biased toward the wheel tread surface, and a stopper for restraining the cleaning element from approaching the wheel tread surface, so that by utilizing a forward and backward movement of the wheel axle in the travel direction caused by steering, the cleaning element makes contact only on the inner rail side toward which the wheel tread surface approaches when passing through a curved section, whereas not making contact on the outer rail side from which the wheel tread surface moves away when passing through a curved section and when traveling through a straight section.

The steering truck according to the present invention is able to reduce wear on the cleaning element, because only the cleaning element on the inner rail side toward which the wheel tread surface approaches presses on the wheel tread surface when passing through a curved section, whereas the cleaning element does not make contact with the wheel tread surface on the outer rail side from which the wheel tread surface moves away when passing through a curved section and when traveling through a straight section.

Advantageous Effects of the Invention

According to the present invention, it is possible to reduce wear on the cleaning element, because of a design which utilizes the forward and backward movement of the wheel axle in the direction of travel of the steering truck in a curved section, so that only a cleaning element on the inner rail side toward which the wheel tread surface approaches comes into contact with the wheel tread surface when passing through a curved section, thereby removing oil adhering to the wheel tread.

BRIEF DESCRIPTION OF THE DRAWINGS

FIG. 2(*a*) is a drawing of the inner rail side where the wheel approaches the truck frame.

FIG. 2(*b*) is a drawing of the outer rail side where the wheel moves away from the truck frame.

FIG. 4(*a*) illustrates a case when traveling through a straight section.

FIG. 4(*b*) is a drawing of the inner rail side where the wheel approaches the truck frame when passing through a curved section.

FIG. 4(*c*) is a drawing of the outer rail side where the wheel moves away from the truck frame when passing through a curved section.

PREFERRED EMBODIMENT

The object of the present invention, which is to reduce wear on a cleaning element, is achieved by a design such that only the cleaning element on the inner rail side toward which the wheel tread surface approaches and makes contact with the truck frame when passing through a curved section, and such that the cleaning element does not make contact on the outer rail side from which the wheel moves away from the truck frame when passing through a curved section and when traveling through a straight section.

EXAMPLE

Figure 1:
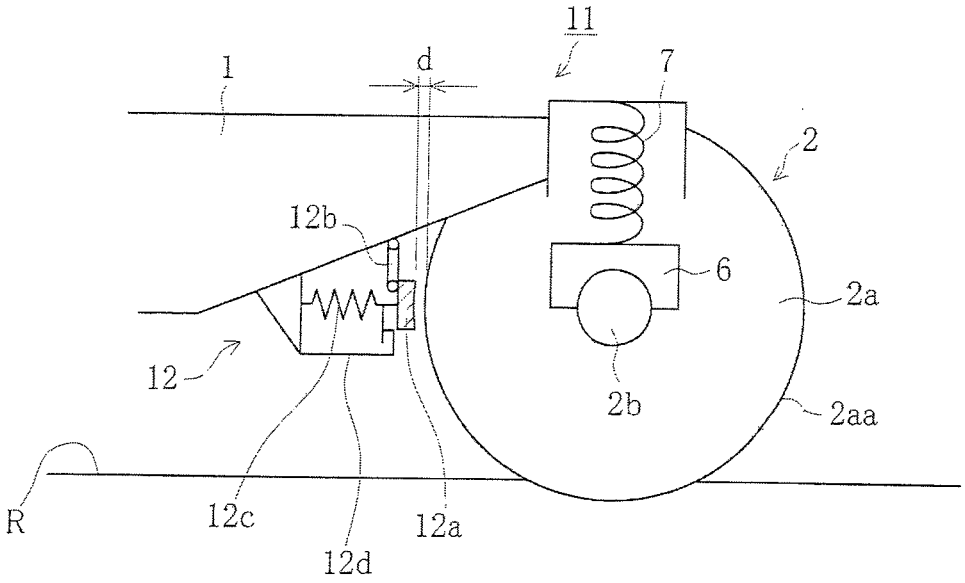
FIG. 1 is drawing illustrating the essential elements of the steering truck according to the present invention when traveling through a straight section.
Figure 2:
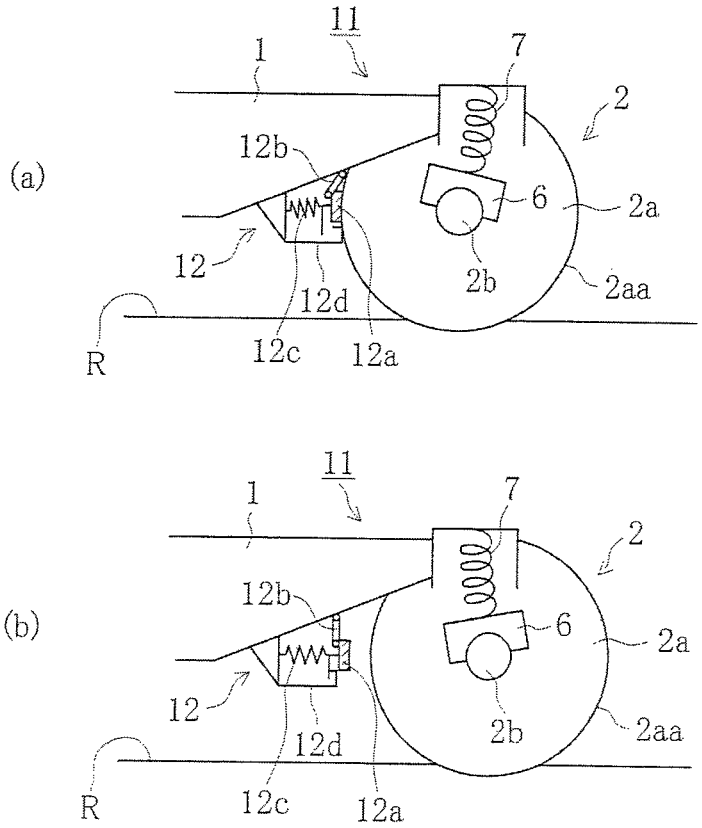
FIG. 2 is drawing illustrating the essential elements of the steering truck according to the present invention when passing through a curved section.

An embodiment of the present invention is described below, using FIG. 1 and FIG. 2. FIG. 1 is drawing illustrating the essential elements of the steering truck according to the present invention when traveling through a straight section. FIG. 2 is a drawing illustrating the essential elements of the steering truck according to the present invention when passing through a curved section.

Reference Numeral 11 is a steering truck of the present invention which employs a steering apparatus to move a wheel axle 2 forward and backward in the travel direction of the vehicle when passing through a curved section. A cleaning element 12*a* is attached to a truck frame 1 in a position facing a tread surface 2*aa* of a wheel 2*a*, and moves freely to come into contact with and to move away from the tread surface 2*aa*, for example.

In FIG. 1 and FIG. 2, the cleaning element 12*a* is mounted to the truck frame 1 in a position facing the tread surface 2*aa* of the wheel 2*a*, via a link 12*b*, in a position in the center along the forward and backward direction of travel of the truck.

Reference Numeral 12*c* is a pressing-load application spring which presses on the cleaning element 12*a* so as to be constantly biased toward the tread surface 2*aa* of the wheel 2*a*, to remove oil and the like which adhere to the tread surface 2*aa*. According to the present invention, a constant pressure type of wheel tread surface cleaning system 12 is employed due to its advantageous manufacturing cost.

However, if a constant pressure type of wheel tread surface cleaning system 12 is installed by itself in the steering truck 11, the cleaning element 12*a* mounted on the inner rail side where the wheel 2*a* approaches truck frame 1 applies a pressing force to the tread surface 2*aa* which is greater than in a typical truck, so wear readily occurs when passing through a curved section.

Since the primary objective of cleaning the tread surface 2*aa* of the wheel 2*a* is to remove oil adhering to the tread surface 2*aa* so as to prevent sliding, it is advantageous to clean only the tread surface 2*aa* of the wheel 2*a* on the inner rail side of a curved section where surface lubrication has been applied. On the other hand, in the steering truck 11, the wheel axle 2 moves forward and backward in the direction of travel depending on the radius of curvature when only passing through a curved section.

Therefore, when the wheel axle 2 moves forward and backward in the direction of travel when passing through a curved section, it is advantageous for the cleaning element 12*a* to be brought into contact with the tread surface 2*aa* of the wheel 2*a* only on the inner rail side where the wheel 2*a* approaches the truck frame 1.

Accordingly, the present invention is designed to press the cleaning element 12*a* only on the tread surface 2*aa* of the wheel 2*a* on the inner rail side approaching the truck frame 1 when passing through a curved section, by activating a forward and backward movement of the wheel axle 2 of the steering truck in the direction of travel when passing through a curved section.

In other words, according to the present invention, there is provided a stopper 12*d* for restraining the cleaning element 12*a* from approaching the tread surface 2*aa*, so that the cleaning element 12*a* does not make contact with the tread surface 2*aa* of the wheel 2*a* when traveling through a straight section, as shown in FIG. 1.

For example, in the examples shown in FIG. 1 and FIG. 2, the spring 12*c* has the base end side being affixed and the forward end to which the cleaning element 12*a* is attached, and the stopper 12*d* prevents an extension of the spring 12*c* at the forward end side of the spring to thereby restrain the cleaning element 12*a* from approaching the tread surface 2*aa*.

A surface lubricating device which supplies oil to the tread surface is installed only at sharp curves, i.e., curves with a small diameter of curvature.

Therefore, according to the present invention, a gap d between the tread surface 2*aa* of the wheel 2*a* and the cleaning element 12*a* during travel through a straight section is slightly smaller than the amount of forward and backward movement of the wheel axle 2 when the steering truck 11 passes through a curve having a maximum radius of curvature where a surface lubricating device is installed, for example.

If this is the case, it becomes possible to reduce the wear on the cleaning element 12*a*, because the time when the cleaning element 12*a* comes into contact with the tread surface 2*aa* of the wheel 2*a* can be limited only to the time when passing through a curved section where a surface lubricating device is installed.

If the cleaning element 12*a* is disposed in a position to freely come into contact with and to move away from the tread surface 2*aa*, then any position is acceptable, but it is desirable from the standpoint of maintenance to install it in a position as horizontal and parallel to the direction of height of the rail R as possible, in a position at a height as close to the center of the axle 2*b* as possible.

As shown in FIG. 1, when the steering truck 11 of the present invention having the above-described configuration travels through a straight section where no surface lubricating device is installed, the gap d is present between the cleaning element 12*a* and the tread surface 2*aa* of the wheel 2*a*, so the cleaning element 12*a* and the tread surface 2*aa* do not come into contact.

On the other hand, when passing through a curved section where a surface lubricating device is installed, contact occurs only on the inner rail side toward which the tread surface 2*aa* of the wheel 2*a* approaches (see FIG. 2(*a*)), due to the forward and backward movement of the wheel axle 2 in the travel direction caused by steering, so as to clean debris such as oil adhering to the tread surface 2*aa*. At this time, there is no contact with the outer rail side from which the tread surface 2*aa* of the wheel 2*a* moves away (see FIG. 2(*b*)).

That is to say, according to the steering truck 11 of the present invention, for example, only the tread surface 2*aa* of the wheel 2*a* positioned on the inner rail side is cleaned by the cleaning element 12*a* when passing through a curved section where a surface lubricating device has been installed, and no contact occurs on the outer rail side when passing through a curved section, or when travelling through a straight section. It is therefore possible to effectively reduce wear on the cleaning element 12*a*.

In addition, when passing through a curved section where a surface lubricating device has been installed, the pressing of the cleaning element 12*a* operates only on the tread surface 2*aa* of the wheel 2*a* positioned on the inner rail side, and the movement of the wheel 2 of the steering truck is activated, so a separate cylinder or the like is not used. Therefore, the configuration of the system itself is simple and maintenance is easy.

The present invention is not limited to the above-described example, and the preferred embodiment may, of course, be advantageously modified within the scope of the technical ideas recited in the claims.

For example, in the example shown in FIG. 1 and FIG. 2, the cleaning element 12*a* is restrained from approaching the tread surface 2*aa* by preventing an expansion of the spring 12*c* at the forward end side of the spring 12*c* which is affixed at a position on the base end side.

Figure 3:
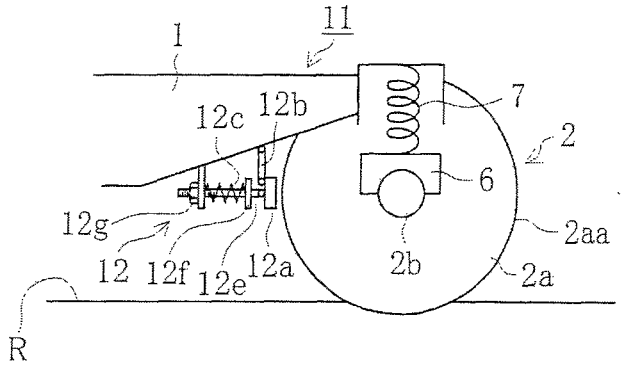
FIG. 3 is a drawing illustrating another example of a stopper for restraining the cleaning element from approaching the wheel tread surface.
Figure 4:
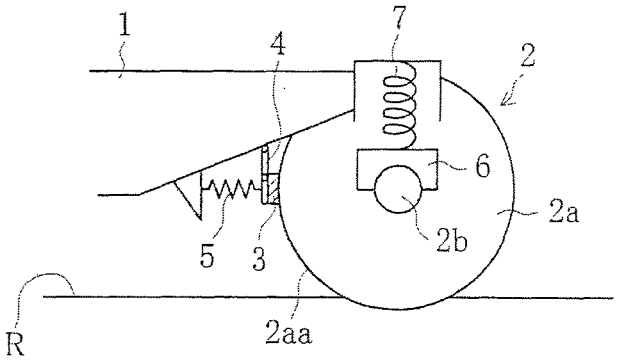
FIG. 4 is a drawing illustrating the essential elements of a steering truck equipped with a constant pressure spring type wheel tread surface cleaning system according to the prior art.
Figure 4:
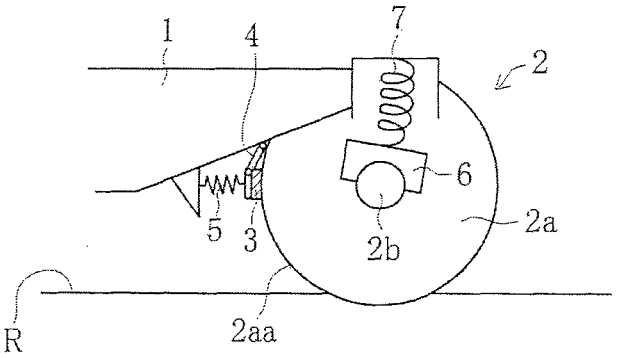
Figure 4:
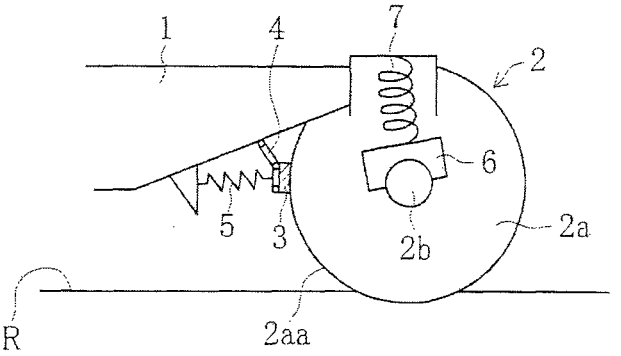

However, as shown in FIG. 3, it is also acceptable for a rod 12*e*, which has at its forward end side a flange 12*f* for restraining the forward end of the spring 12*c*, and which has the cleaning element 12*a* attached to its forward end, to be caused to pass through the spring 12*c* which is affixed at a position on the base end side. In this case, the length of the spring 12*c* is adjusted by tightening a nut 12*g* on the base end side of the rod 12*e*, to restrain the cleaning element 12*a* from approaching the tread surface 2*aa*.

The steering system used in the steering truck according to the present invention can be either an active forced steering system or a semi-forced steering system. An active forced steering system employs an air pressure-type, hydraulic-type, or electric-type actuator to supply energy from outside of the system to actively steer the wheel axle while controlling it. A semi-forced steering system employs a mechanical mechanism such as a link to couple the vehicle body, the truck, and the wheel axles, and employs bogie displacement which occurs between the vehicle body and the truck as a driving force while passing through a curved section.

EXPLANATION OF THE REFERENCE NUMERALS

1 Truck frame
2 Wheel axle
2*a* Wheel
2*aa* Tread surface
2*b* Axle
11 Steering truck
12 Cleaning system
12*a* Cleaning element
12*c* Spring
12*d* Stopper

The invention claimed is:

1. A railway vehicle steering truck designed to make it possible to steer a wheel axle of the truck, the steering truck comprising a wheel tread surface cleaning system comprising:

a cleaning element mounted to a truck frame of the steering truck in a position facing a wheel tread surface, the cleaning element moving freely to come into contact with and to move away from the wheel tread surface, a pressing-load application spring which presses on the cleaning element biased toward the wheel tread surface, and a stopper for restraining the cleaning element from approaching the wheel tread surface, so that by utilizing a forward and backward movement of the wheel axle in the travel direction caused by steering, the cleaning element makes contact only on the inner rail side toward which the wheel tread surface approaches when passing through a curved section, whereas not making contact on the outer rail side from which the wheel tread surface moves away when passing through a curved section and when traveling through a straight section.

2. The railway vehicle steering truck according to claim 1, wherein the cleaning element is installed as horizontal and parallel to the direction of height of the rail as possible, in a position at a height as close to center of the axle as possible.

3. The railway vehicle steering truck according to claim 1, wherein the cleaning element is mounted in a position in the center along the forward and backward direction of travel of the truck.

4. The railway vehicle steering truck according to claim 3, wherein a gap between the wheel tread surface and the cleaning element during travel through a straight section is smaller than an amount of forward and backward movement of the wheel axle when the steering truck passes through a curve having a maximum radius of curvature where a surface lubricating device is installed.

* * * * *